US007316453B2

(12) United States Patent
Dobkin et al.

(10) Patent No.: US 7,316,453 B2
(45) Date of Patent: Jan. 8, 2008

(54) CHAIR SPRING TENSION CONTROL

(75) Inventors: Israel Dobkin, Thornhill (CA); Marian Cybulsky, Scarborough (CA)

(73) Assignee: Ram Machines (1990) Ltd., Downsview, Ontario (CA)

( * ) Notice: Subject to any disclaimer, the term of this patent is extended or adjusted under 35 U.S.C. 154(b) by 360 days.

(21) Appl. No.: 10/971,763

(22) Filed: Oct. 25, 2004

(65) Prior Publication Data

US 2005/0104429 A1 May 19, 2005

(30) Foreign Application Priority Data

Oct. 24, 2003 (CA) ..... 2446654

(51) Int. Cl.
*A47C 1/024* (2006.01)

(52) U.S. Cl. ..... 297/303.4; 297/302.4; 297/300.5

(58) Field of Classification Search ..... 297/303.4, 297/302.4, 301.4, 300.5, 175, 177
See application file for complete search history.

(56) References Cited

U.S. PATENT DOCUMENTS

| | | | | |
|---|---|---|---|---|
| 1,926,259 | A * | 9/1933 | Bitzenburger | 297/301.4 |
| 2,110,874 | A * | 3/1938 | Herold | 297/300.5 |
| 3,453,024 | A * | 7/1969 | Williams | 297/300.5 |
| 4,744,600 | A * | 5/1988 | Inoue | 297/300.5 |
| 4,830,431 | A | 5/1989 | Inoue | |
| 2001/0013569 | A1 | 8/2001 | Donati | |

* cited by examiner

*Primary Examiner*—Sarah B. McPartlin
(74) *Attorney, Agent, or Firm*—Bereskin & Parr

(57) ABSTRACT

A tilt mechanism for an office chair includes a spring tension control that incorporates a wedge arrangement including a moveable wedge component that is displaceable laterally by turning a control knob below the seat of the chair, to force fixed wedge components apart and increase the spring tension. Turning the knob in the opposite direction reduces spring tension.

2 Claims, 5 Drawing Sheets

CHAIR SPRING TENSION CONTROL

FIELD OF THE INVENTION

This invention relates generally to tilt mechanisms for office chairs, and is concerned more particularly with a spring tension control for such a mechanism.

BACKGROUND OF THE INVENTION

A typical office chair includes a seat/back assembly which is coupled to a chair base by a mechanism that allows controlled tilting of the seat/back assembly with respect to the base. The base usually has an upright post which carries a lower, stationary housing part of the tilt mechanism. Pivoted to the stationary housing part is an upper housing part that carries the seat/back assembly. The back may or may not be movable with respect to the seat. A spring extends between the two housing parts of the tilt mechanism and normally maintains the parts in a rest position with respect to one another. When a person sitting on the chair leans back, the upper housing part tilts with respect to the lower housing part and the spring is compressed, cushioning the tilting movement. The spring tension is adjustable to vary the degree of cushioning.

Usually, the spring is a cylindrical coil spring which is mounted on the fixed part of the housing so as to project downwardly below the front center region of the seat. A rod extends back through the spring and has an inner end which is coupled to the upper, tilting part of the housing. The outer end of the rod carries a cup-shaped cap which embraces the outer end portion of the spring and bears against its outer end. When the seat/back assembly is tilted back, the rod draws the cap inwardly, compressing the spring. The cap is coupled to the rod by screw threads so that the tension in the spring can be adjusted by turning the cap, causing it to move along the rod.

While this form of spring tension control works reasonably well, it is somewhat awkward to use. A person seated on the chair must bend forwardly, and then reach down and rearwardly between his or her legs, grasp the cap and turn it in the appropriate direction to increase or decrease spring tension as required.

SUMMARY OF THE INVENTION

An object of the present invention is to provide a spring tension control mechanism which can be designed so that it is less awkward to use than the prior art mechanism referred to above.

Accordingly, the present invention provides a tilt mechanism for a chair comprising upper and lower housing parts adapted to be coupled respectively to a chair seat/back assembly and to a chair base, the parts being pivoted together for movement with respect to one another to permit tilting of the seat/back assembly with respect to the base in use. A compression spring is coupled between the upper and lower housing parts so as to normally maintain the parts in a rest position, while being compressed when the upper housing part tilts with respect to the lower housing part in use. The mechanism also includes a spring tension control. One end of the spring bears against one of the housing parts of the mechanism and the tension control comprises wedge means disposed between that end of the spring and the relevant housing part. The wedge means includes a fixed wedge component coupled to either the spring or the housing part and a moveable wedge component which acts between the fixed wedge component and the other of the spring and the housing part. The moveable wedge component is displaceable laterally with respect to the longitudinal axis of the spring and the respective wedge components have co-operating sliding surfaces angled so that displacement of the moveable component towards said axis compresses the spring, increasing spring tension, while displacement of the moveable wedge component away from said axis allows the spring to relax, reducing spring tension. The mechanism also includes an operator controlled actuator for effecting lateral displacement of the moveable wedge component.

Typically, the compression spring will be located so that its axis is generally upright when the tilt mechanism is installed on a base and carrying a seat/back assembly. This means that the moveable wedge component is displaceable generally horizontally, for example at a location below the seat of the chair. Such movement can be accomplished by designing the operator controlled actuator to incorporate a screw threaded arrangement for moving the wedge component in and out to control the spring tension. For example, the actuator may comprise a rod that projects laterally to the side of the chair below the seat and that has a knob at its outer end that a user of the chair can conveniently reach down and turn to adjust the spring tension. This is a much more convenient and less awkward action than that required to adjust a conventional spring tension control (as described above).

In a mechanism according to the invention, the compression spring typically is positioned and arranged generally in the same fashion as in the prior art mechanism. In other words, the spring is mounted on the fixed lower part of the housing and projects downwardly below the front center region of the seat. A rod extends back through the spring and has its inner end coupled to the upper part of the housing while its outer end carries a cap which bears against the outer end of the spring. In contrast to prior art mechanisms, however, there is no turnable cap. Instead, the wedge means of the invention preferably is located between the inner end of the spring and the lower housing part.

Preferably, fixed wedge components are provided both on the lower housing part and on the inner end of the spring and the moveable wedge component acts between oppositely outwardly inclined surfaces of the fixed wedge components. In fact, the wedge means preferably is symmetrical and includes two moveable wedge components that move in and out at opposite sides of the control when the actuator is operated, with each wedge component acting between one of two pairs of outwardly angled wedge surfaces on the two fixed wedge components. In this way, the forces acting on the spring are balanced, which should ensure smooth of the operation of the wedge means and avoid binding.

BRIEF DESCRIPTION OF THE DRAWINGS

In order that the invention may be more clearly understood, reference will now be made to the accompanying drawings which illustrate a particular preferred embodiment of the invention by way of example, and in which.

DESCRIPTION OF PREFERRED EMBODIMENT

Figure 1:
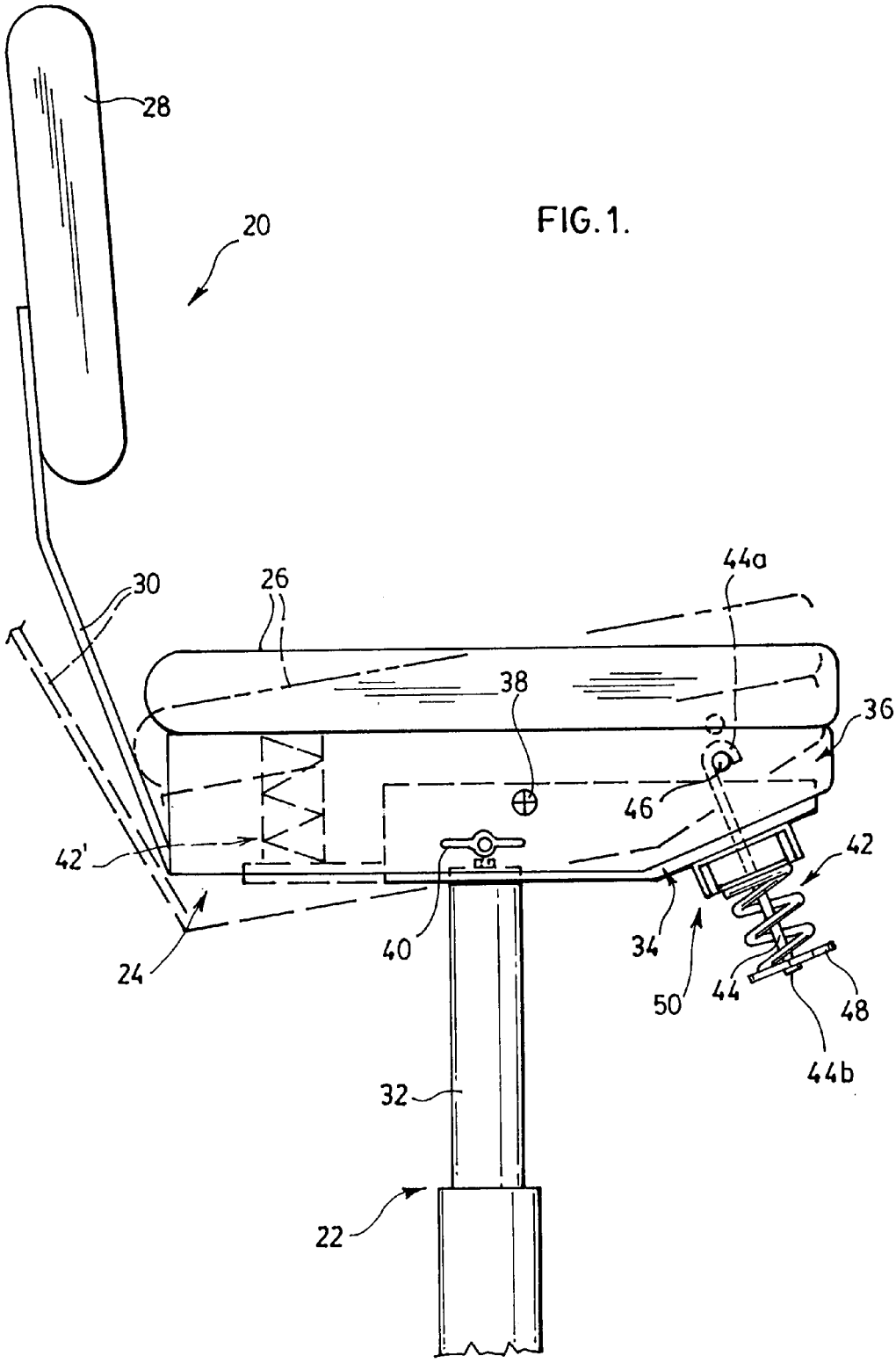
FIG. 1 is a schematic side elevational view of a typical office chair fitted with a tilt mechanism in accordance with the present invention.

Referring first to FIG. 1, a typical office chair is seen to comprise a seat/back assembly 20 which is coupled to a chair base 22 by a mechanism 24 which allows controlled tilting of the seat/back assembly with respect to the base. The mechanism is shown in full lines in a normal rest position in which the seat (26) is generally horizontal, and in ghost outline in a tilted back position in which the seat 26 is rearwardly inclined, also as shown in ghost outline. The back 28 is connected to the tilt mechanism by an arm 30 (also seen in FIG. 2) so that the back also tilts. In this embodiment, the orientation of the seat 26 and back 28 with respect to one another is fixed, although the tilt mechanism can be designed to allow tilting movement of the back with respect to the seat, as is well known in the art.

The chair base is essentially conventional and in this case includes a telescopic upright column 32 that carries the tilt mechanism 24. Mechanism 24 has a fixed lower housing part 34 which is mounted to the top of the base column 32, and an upper housing part 36 which is pivotable with respect to the lower housing part about a transverse axis indicated at 38 in FIG. 1.

Column 32 incorporates a pneumatic cylinder which can be controlled by a control rod 40 (also shown in FIG. 2) to adjust the height of the column, also as is well known in the art.

A compression spring 42 is coupled between the upper housing part 36 and the lower housing part 34 so as to normally maintain those parts in a rest position (the full line position shown in FIG. 1), while being compressed when the upper housing part 36 tilts with respect to the lower housing part in use.

In the illustrated embodiment, the compression spring 42 extends forwardly and downwardly from the front center region of the lower housing part 34. A rod 44 extends back through the spring and has a hook-shaped inner end 44*a* which engages around a transverse bar 46 forming part of the upper housing part 36. Rod 44 has an outer end 44*b* which carries a cap 48 that bears against the outer end of the spring. The inner end of the spring bears against the lower housing part 34 through the intermediary of a spring tension control which is generally indicated at 50 in FIG. 1 and shown in more detail in FIGS. 3, 4 and 5.

Figure 2:
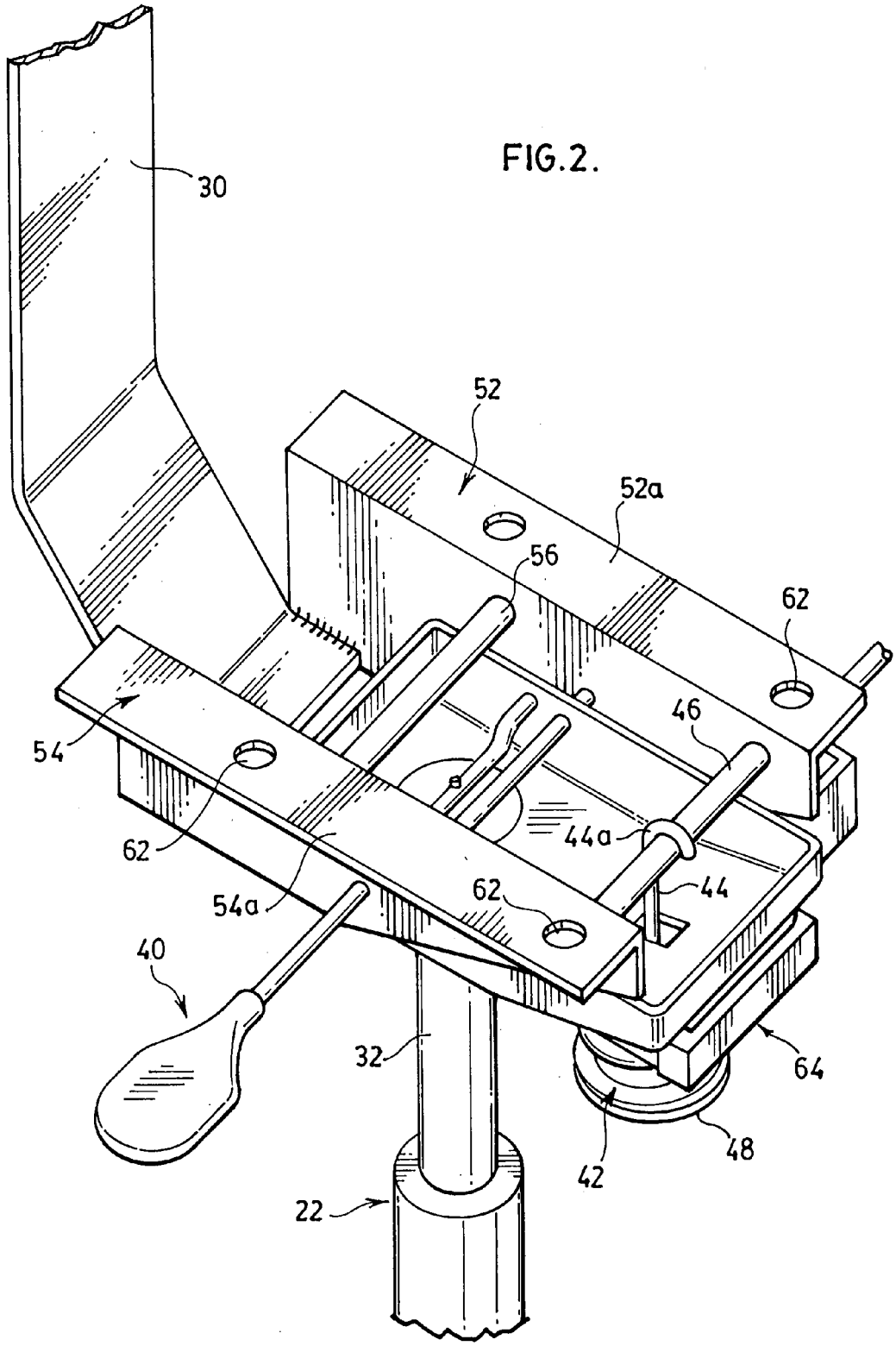
FIG. 2 is a perspective view from above of the tilt mechanism itself, after removal of the seat and back assembly of the chair.

Before referring to those views, reference is made to FIG. 2 which shows the two housing parts 34 and 36 as seen from above. The lower housing part 34 has a generally rectangular shape overall, and the configuration of an open-topped tray. The upper housing part 36 comprises a pair of angle-shaped side members 52, 54 which are connected by bar 46 and a second similar bar 56 and by a pivot shaft that defines the pivot axis 38 between the two housing parts. Also coupled between the two side members 52, 54 is the arm 30 that carries the back 28 of the seat/back assembly. The control rod 40 for the pneumatic cylinder of the base column 32 is also visible in FIG. 2.

The two side members 52, 54 of the upper housing part 36 are angle shape in cross section and have respective laterally directed top flanges 52*a* and 54*a* that serve as supports for the seat 26, and have holes 62 through which the seat is bolted to the tilt mechanism.

Figure 3:
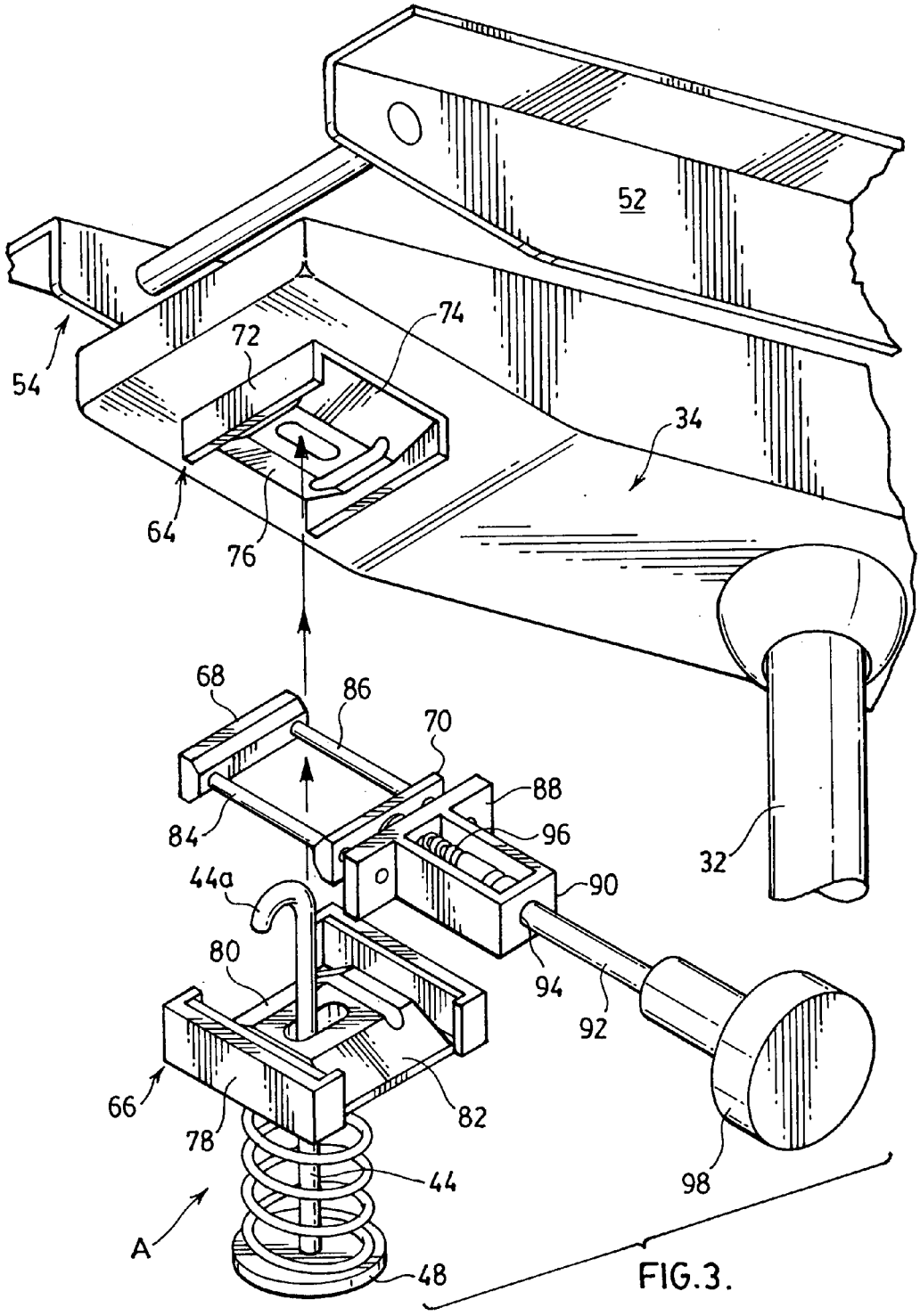
FIG. 3 is an exploded perspective view showing the wedge means of the tilt mechanism in association with the fixed lower housing part of the tilt mechanism and the spring.
Figure 4:
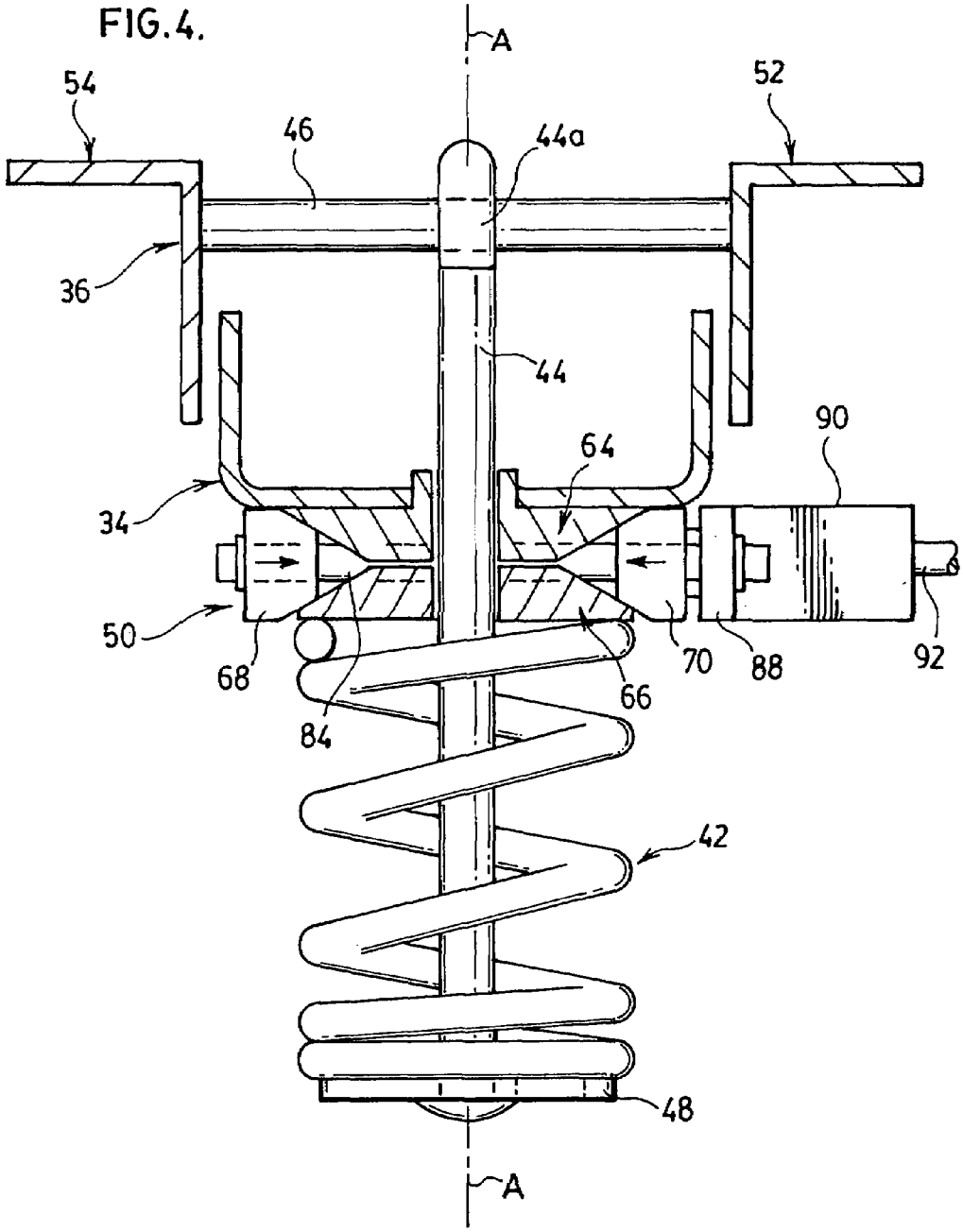
FIG. 4 is an elevational view in the direction of arrow A in FIG. 3, showing the mechanism assembled; and, FIG. 5 is a view similar to FIG. 4 illustrating how the wedge means is operated to compress the spring.
Figure 5:
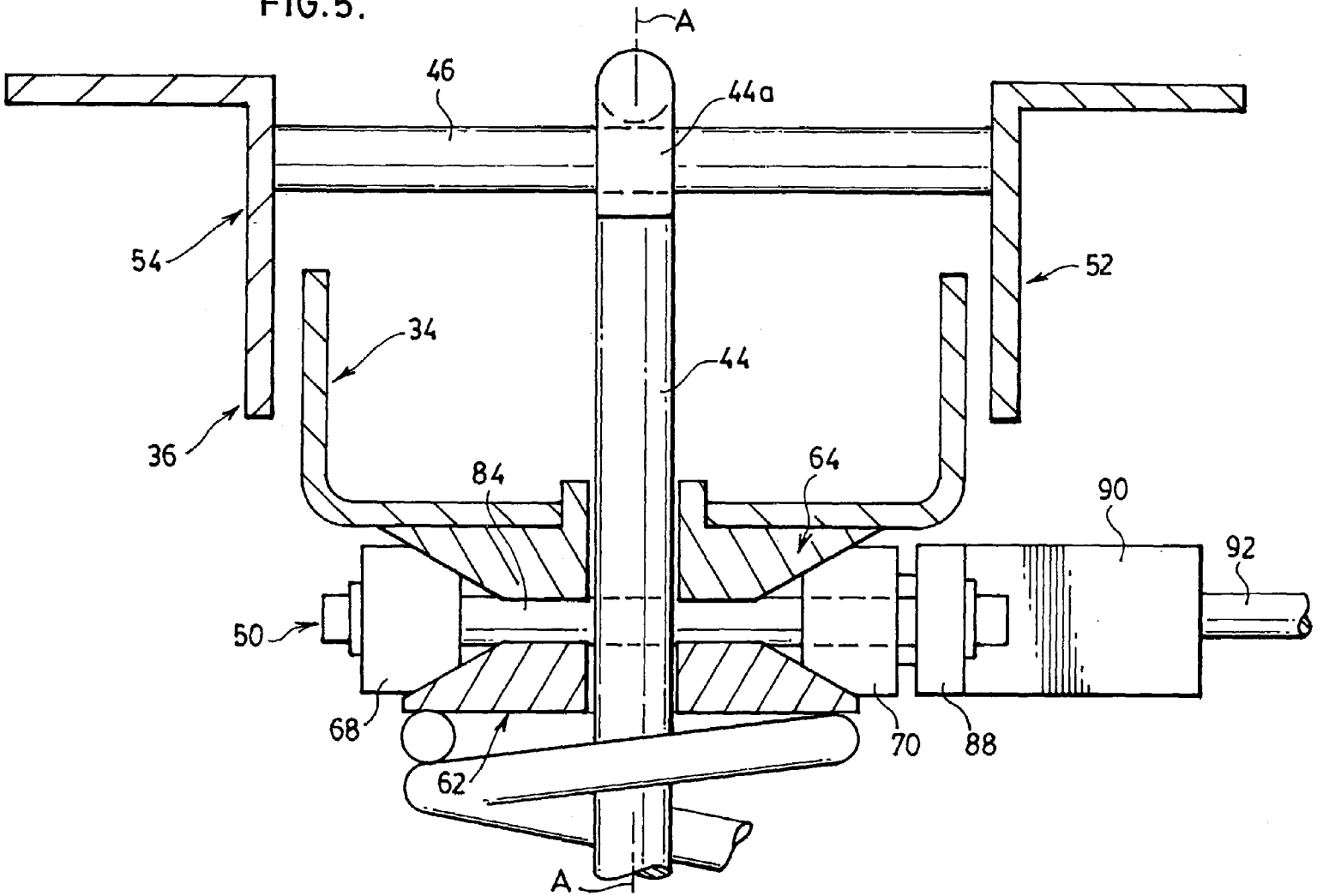

Reference will now be made to FIGS. 3, 4 and 5 in describing the spring tension control 50 of the tilt mechanism. Essentially, the tension control comprises an arrangement of wedges between the inner end of the compression spring 42 and the fixed lower housing part 34 (see FIG. 4). Specifically, the tension control includes a pair of fixed wedge components 64 and 66, one of which (64) is mounted on the fixed housing part 34, while the other (66) bears against the inner end of the spring 42. A pair of movable wedge components 68, 70 act between the fixed wedge components to either force them apart and increase spring tension, or allow them to move together, decreasing spring tension. FIG. 4 shows the two fixed wedge components in contact with one another in the position of minimum spring tension, while FIG. 5 shows the movable wedge components 68, 70 as having been moved inwardly, forcing the fixed wedge components apart and increasing spring tension.

In FIG. 4, the longitudinal axis of the compression spring 42 is indicated at A-A and the two moveable wedge components 70 move in or out, laterally with respect to that axis, i.e. generally horizontally considering the tilt mechanism in its installed position as shown in FIG. 1.

FIG. 3 shows the respective wedge components in more detail. It will be seen that the two fixed wedge components 64 and 66 are generally similar in that each component has a generally U-shaped housing with open ends, and a profiled bottom face defining a pair of ramp-like inclined surfaces on which the moveable wedge components 68, 70 slide. In the case of fixed wedge component 64, the housing is generally denoted 72 and the two inclined surfaces 74 and 76 respectively. Component 66 is similar and has a housing 78 and inclined sliding surfaces 80 and 82. The two housings 72 and 78 are shaped to fit together around the two moveable wedge components 68, 70 in the assembled spring tension control.

The two moveable wedge components 68, 70 are positioned for co-operation with the respective pairs of inclined surfaces 76, 80 and 74, 82. A pair of shafts 84, 86 extend between the two moveable wedge components 70. Outer ends of those shafts are fixed to component 68 while the opposite ends extend through openings in component 70 and are attached at their inner ends to a transverse plate 88 of a yoke 90. An operator controlled rod 92 for moving the two wedge components 68, 70 extends through a plain opening 94 in the yoke and has a screw-threaded portion 96 adjacent its outer end which extends through a complimentarily threaded opening in plate 88. Rod 92 is then rotationally coupled at its outer end to wedge component 70. A control knob 98 at the outer end of rod 92 is positioned for convenient operation by a person seated on the chair.

By turning knob 98, say, in a clockwise direction, wedge component 70 is moved towards wedge component 68, guided by the two shafts 84, 86. Yoke 90 is free to float so that, in the assembled tension control, the effect of turning rod 92 in the clockwise direction is to draw the two moveable wedge components 68, 70 towards one another so that they ride up the respective sliding surfaces on the stationary wedge component 64, 68, in symmetrical fashion. This has the effect of moving the two fixed wedge components apart, for example to the position shown in FIG. 5, compressing spring 42. Conversely, if the rod 92 is turned in the opposite direction, the force of spring 42 moves the two fixed wedge components 64, 66 towards one another as the moveable wedge component 68, 70 move apart.

As noted previously, an advantage of the tilt mechanism provided by the invention is that the spring tension control can conveniently be operated by a person seated on the chair, simply by reaching down to the side of the chair and turning knob 98. No awkward bending or reaching between the legs is required.

It will of course be appreciated that the preceding description refers to a particular preferred embodiment of the invention only and that many modifications are possible. For example, though the preferred embodiment utilizes a symmetrical wedge arrangement having two moveable wedge components (68, 70) co-operating with two fixed wedge components (64, 66) this is not essential within the broad scope of the invention. In the minimum case, there could be a single moveable wedge component co-operating with a single fixed wedge component corresponding to either of the components 64, 66. The other component could be replaced, for example, by a flat surface that would co-operate with a corresponding flat surface on the moveable wedge component.

It should also be noted that the tilt cushioning spring 42 can be located other than as shown in FIG. 1 of the drawings. For example, the dotted outline denoted 42' indicates a possible alternative location for the spring between the upper and lower housing parts. An extension 34' is required for the lower housing part. The spring tension control 50 could then be positioned at either end of the spring. Similarly, in the illustrated embodiment, the spring tension control indicated at 50 in FIG. 1 could conceivably be positioned at the outer end of spring 42 between the plate 48 and the outer end of the spring. In that event, the control would effectively bear against the upper housing part 36, by way of rod 44.

The invention claimed is:

1. A tilt mechanism for a chair comprising:

upper and lower housing parts adapted to be coupled respectively to a chair seat/back assembly and to a chair base, said parts being pivoted together for movement with respect to one another to permit tilting of the seat/back assembly with respect to the base in use;

a compression spring extending about an axis and coupled to the upper and lower housing parts so as to normally maintain said parts in a rest position while being compressed when the upper housing part tilts with respect to the lower housing part in use, one end of said spring bearing against one of said housing parts; and, a spring tension control including wedge means between said one end of the spring and said one housing part, said wedge means comprising a fixed wedge component coupled to one of said spring and said housing part and a movable wedge component acting between the fixed wedge component and the other of the spring and housing part, said moveable wedge component being displaceable laterally with respect to said axis of the spring, the respective wedge components having co-operating sliding surfaces angled so that displacement of the moveable wedge component towards said axis compresses the spring increasing spring tension, while displacement of said moveable wedge component away from said axis allows the spring to relax, reducing spring tension; and an operator controlled actuator for effecting said displacement of the moveable wedge component;

wherein said spring tension control further comprises a second moveable wedge component which is displaceable laterally with respect to the axis of the spring, said moveable wedge components being disposed on opposite sides of said spring axis and being moveable towards and away from one another in opposite directions, said fixed wedge component including respective pairs of sliding surfaces on opposite sides of said axis for co-operating with said moveable wedge components, said wedge means being symmetrical about said axis for exerting a balanced compression force on said compression spring in use, and wherein said operator controlled actuator comprises a turnable rod that extends laterally with respect to said spring axis, and screw-threaded coupling means between said rod and said moveable wedge components for moving said components towards or away from one another in response to turning of said rod in opposite rotational directions;

and wherein said screw-threaded coupling means comprises a floating yoke through which said actuator rod extends and to which the rod is coupled by co-operating screw threads, an inner end of said rod co-operating with a first one of said moveable wedge components so that turning of the rod with respect to the yoke causes movement of that wedge component towards and away from said spring axis, the other moveable wedge component being coupled to said yoke by guide means extending through said first moveable wedge component and coupled to said yoke so as to cause relative inward or outward movement of the moveable wedge components with respect to one another in response to turning of said rod.

2. A tilt mechanism as claimed in claim 1, wherein said compression spring extends downwardly from a forward center region of said lower housing part and said wedge means is disposed between said lower housing part and an inner end of said spring, said spring being coupled to said upper housing part by a rod which extends through said spring generally on said axis and which has an inner end coupled to said upper housing part and an outer end which is coupled to a cap that bears against the outer end of the spring.

* * * * *